US005980442A

United States Patent [19]

Hamilton et al.

[11] Patent Number: 5,980,442

[45] Date of Patent: Nov. 9, 1999

[54] APPARATUS AND METHOD OF PRODUCING A FOOD SERVER WITH PRE-FOLD OF GLUE PANELS

[76] Inventors: James T. Hamilton, 328 Sycamore Dr., Naperville, Ill. 60540; Brian J. Hamilton, 903 W. Benton Ave., Naperville, Ill. 60540; David A. Hamilton, 1513 Clarkson Ct., Naperville, Ill. 60565

[21] Appl. No.: 08/872,224

[22] Filed: Jun. 10, 1997

[51] Int. Cl.[6] ..... B31B 1/14; B31B 1/26

[52] U.S. Cl. ..... 493/235; 493/55; 493/70; 493/74; 493/81; 493/100; 493/88; 493/223; 493/131; 493/236; 493/254; 493/241

[58] Field of Search ..... 493/187, 188, 493/193, 194, 198, 199, 216, 220, 221, 223, 224, 53, 54, 55, 56, 59, 60, 62, 63, 64, 69, 70, 71, 72, 74, 79, 80, 81, 82, 114, 115, 117, 120, 123, 125, 131, 235, 236, 254, 241, 130

[56] References Cited

U.S. PATENT DOCUMENTS

| | | | |
|---|---|---|---|
| 2,153,848 | 4/1939 | Shea et al. | 493/235 |
| 3,143,022 | 8/1964 | Anderson . | |
| 3,430,410 | 3/1969 | Heisler | 493/88 |
| 3,552,282 | 1/1971 | Wilson . | |
| 3,559,875 | 2/1971 | Wilson . | |
| 4,016,708 | 4/1977 | DeHart . | |
| 4,156,336 | 5/1979 | Tabaroni et al. . | |
| 4,173,922 | 11/1979 | Helm | 493/235 |
| 4,319,878 | 3/1982 | Dozier et al. | 493/131 |
| 4,450,740 | 5/1984 | Chapman, Jr. et al. . | |
| 4,521,209 | 6/1985 | DuFrense | 493/432 |
| 4,569,672 | 2/1986 | Marion et al. . | |
| 5,049,117 | 9/1991 | Mueller . | |
| 5,155,968 | 10/1992 | Mosse et al. | 493/315 |
| 5,263,637 | 11/1993 | Simson | 493/187 |
| 5,409,441 | 4/1995 | Muscoplat | 493/223 |
| 5,496,250 | 3/1996 | Fiedler et al. | 493/169 |

*Primary Examiner*—Peter Vo
*Assistant Examiner*—Eric J. Weierstall
*Attorney, Agent, or Firm*—Trexler, Bushnell, Giangiorgi & Blackstone, Ltd.

[57] ABSTRACT

A novel food server and method of producing a food server is disclosed. The novel method includes moving a web of paper at a constant rate of speed, rotary perforating a plurality of lines on the moving web, using rotary timing belts to score at least two fold lines on the moving web, where the two fold lines define two glue flaps, rotary die-cutting the moving web to cut away portions of the paper adjacent the glue flaps, plow folding the moving web along the two fold lines defining the glue flaps, and applying glue to the moving web. After plow folding along the fold lines and applying the glue, the moving web is cross cut to form a blank having the glue flaps. Then, the blank is vacuum folded to cause portions of the blank to contact and adhere to the glue flaps, thereby forming the food server from the blank. The novel food server includes a first panel having two side flaps each defined by a score line, and a second panel having two side flaps each defined by a score line. Each of the side flaps on the second panel has an outside portion and an inside portion defined by a score line. There is adhesive between each of the outside portions and each of the side flaps on the first panel, thereby providing that the first panel is adhered to the second panel to form the food server.

11 Claims, 10 Drawing Sheets

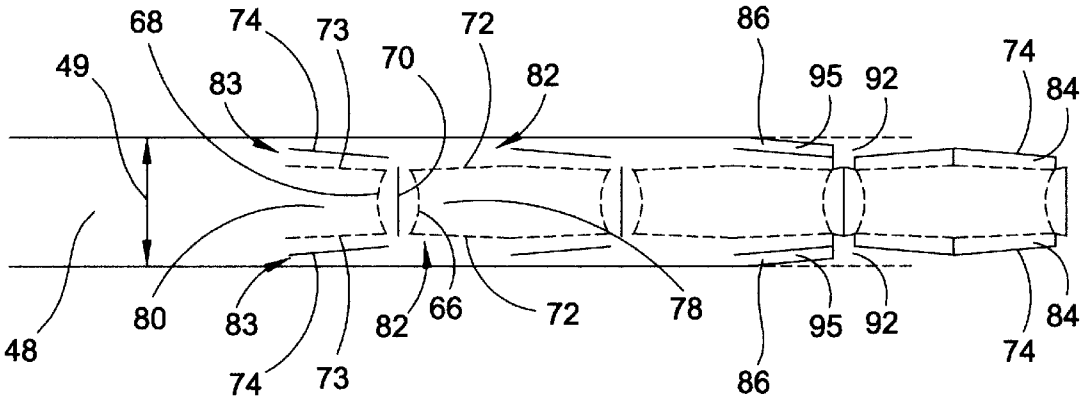
FIG. 6b'
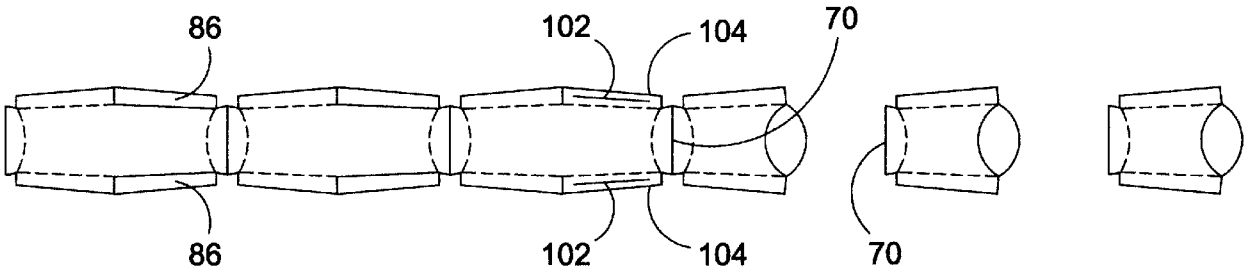
FIG. 6b"

APPARATUS AND METHOD OF PRODUCING A FOOD SERVER WITH PRE-FOLD OF GLUE PANELS

BACKGROUND

Presently, food servers, such as containers for serving french fries in a fast food restaurant, are manufactured using a two stage process. The first stage of the process consists of several steps each of which is performed to a web of paper board in order to produce a stack of identical blanks therefrom. Shown in FIG. 1 is the typical blank 10 formed by the first stage of the process. To form the blanks from the web of paper board, the web is first unwound from a roll and sent to one or more printing stations where indicia such as a logo and an associated design is printed thereon. After the printing, the paper board is forwarded to a punch die-cutting station where the paper board is die cut, creased and perforated using a flat steel rule die to form several fold lines 12, 14 and 16 onto the paper board and to define a front panel 18, a back panel 20, glue flaps 22, bottom panels 24 and side panels 26 thereon. After being die cut, the die cut web, which has several blanks 10 nicked together, is forwarded through a rotary stripping station which automatically removes the die cut trim away from the die cut and creased paper board blanks. The nicked together, die cut blanks are then forwarded to a set of speed up rolls which break the nicks and then feed the separated blanks onto a slow down belt in a shingled fashion. The blanks are then manually removed from the shingle belt onto a pellet where they are stored awaiting the ensuing operation of folding, gluing and packing.

The punch press die cutting step requires that the paper board being cut and creased be of sufficient stiffness to allow for stopping the web in the punch press, die cutting the paper board with a minimum number of nicks and accelerating the cut web into the rotary stripper. The above-described first stage of the process will not work on light weight paper.

The second stage of the process consists of folding and gluing the glue flaps 22 of each blank 10. The folding and gluing is performed in a way that will only provide glue flaps 22 adhered to the outside surface 28 of the back panel 20. The process does not provide that the glue flaps 22 can be adhered to the inside surface of the back panel 20. The second stage of the process provides that a person folds the die cut blanks into a folder/gluer. The person selects a small stack of blanks 10 and hand folds the small stack along score line 12 so that the flat stack becomes an angled stack. This pre-bent stack is then placed into the feeder section of the folder/gluer where blanks 10 are fed off the bottom of the pre-bent stack and each blank 10 is first folded along fold line 12. Glue is applied to glue flaps 22, and then the blank 10 is folded with flat twisted belts along fold lines 14 which completes the folding. The paper board containers are then fed into a pressure belt system that sets the glue. After glue is applied to the glue flaps 22, food server 30 is formed, the rear 32 of which is shown in FIG. 2. As shown, the rear 32 of the food server 30 is defined by two side panels 26, a bottom panel 24, and two glue flaps 22 each of which is adhered to the outside surface 28 of the back panel 20. After gluing, the food servers 30 are ready for packing.

The above-described two stage process requires that a paper board having a high stiffness be used in order to achieve efficient high speed non-parallel fold lines (for example, fold lines 14). Additionally, the folder/gluer requires that a very stiff paper board be used (for example, 0.012 to 0.014 inches thick) in order to be able to feed a single blank at a time into the folder/gluer. Even if one were to adapt the abovedescribed two stage process to run lighter weight paper board, a significant cost savings would not be realized because paper board mills normally sell their paper board with calipers below twelve to thirteen for about the same price per square foot.

After the food server 30 is manufactured, the food server 30 is shipped to the food vendor, such as to a fast food restaurant. When food, such as french fries, is to be placed in the food server 30 and served by the food vendor, the sides 34 of the food server are urged toward each other to cause the bottom panels 24 to shift upward thereby locking the food server 24 into a position which provides an opening for the food. The glue flaps 22 essentially render the rear 32 of the food server 30 less practical for printing any attention-grabbing graphics thereon. Preferably, a folder carton (paper board) product is formed and glued with the glue flaps on the inside so that one can better use the full panel for graphics.

Because the first stage of the two stage process described above consists of stopping a moving web of paper board to perform certain steps (for example, punch die-cutting scrap therefrom), the first stage of the process severely limits the speed at which food servers can be produced. Additionally, the fact that one must hand fold small stacks of blanks prior to placing them in the folder/gluer infeed station adds substantial extra labor to the process.

Additionally, as mentioned, one of the steps performed to the web of paper board during the first stage of the above-described process includes punch die-cutting scrap from the paper board. Because the paper board is punch die-cut, it is imperative that a relatively heavy paper board, such as one hundred thirty pound paper board, be used so that the paper board does not jam during the punch die-cutting step. Of course, the heavier the paper board used, the higher the cost of producing a food server therefrom. Additionally, using heavier paper board is presently undesirable in light of recent worldwide efforts to conserve materials and limit the amount of material dumped into landfills.

Still further, as shown in FIG. 1, the blank 10 formed during the first stage of the above-described process includes four side panels 26 and two glue flaps 22 located adjacent the front panel 18. Therefore, to provide that scrap is kept to a minimum, the blanks must be "reverse nested" side-by-side on the web. In other words, the layout of the individual blanks on the web must be such that several blanks are aligned and staggered side-by-side on a single web rather than merely aligned front to back in a single file line. As a result of having to provide that the blanks are reverse nested, not only must the web of paper be relatively wide, but the gluing and folding steps of the process must be performed after the individual blanks are cut from the web, as a secondary operation, thus necessitating using the two stage process described above rather than utilizing a single stage process as is provided by the present invention.

The present invention provides a novel food server and a novel method of producing a food server, each directed to solve the problems discussed hereinabove.

OBJECTS OF THE INVENTION AND SUMMARY OF THE DISCLOSURE

A general object satisfied by the claimed invention is to provide a single stage method of producing a food server which significantly reduces the amount of material used.

Another object satisfied by the claimed invention is to provide a method of producing a food server whereby food servers can be produced at an extremely fast rate.

A related objective satisfied by the claimed invention is to provide a method of producing a lightweight paper food server in a continuous operation from a roll of paper to a finished, folded, flat product that can be opened and filled in the same manner as prior art paper board servers.

Still another object satisfied by the present invention is to provide a method of producing a food server whereby lighter weight paper can be used.

Still yet another object satisfied by the present invention is to provide a method of producing a food server using a layout that does not require reverse nesting to achieve material usage efficiency.

A related object satisfied by the present invention is to provide a method of producing a food server using a relatively narrow web of paper to achieve material usage efficiency.

Still another object satisfied by the present invention is to provide a method of producing a food server in a more cost efficient manner.

A still yet further object satisfied by the present invention is to provide a method of producing a food server which minimizes land fill waste.

Still yet another object satisfied by the present invention is to provide a method of producing a food server which eliminates frequent job setups commonly experienced in producing "reverse nested" prior art food servers.

Still yet a further object satisfied by the present invention is to provide a method of producing a food server which reduces stock inventories and permits just-in-time deliveries.

A still further object satisfied by the present invention is to provide a food server having glue flaps that assist in the opening and locking of the food server.

Still yet a further object satisfied by the present invention is to provide a food server having glue flaps that maintain the rear of the food server more practical for printing attention-grabbing graphics thereon such as advertising icon imagery.

Briefly, and in accordance with the foregoing, the present invention envisions a method of producing a food server. The method includes the steps of providing a continuous web of paper, moving the continuous web, printing on at least one surface of the web, scoring fold lines on and die-cutting the moving web, plow folding the moving web to form glue panels thereon, applying glue to the glue panels of the moving web, cutting across the moving web to form a blank separate from the web of moving paper where the blank includes the glue panels, and folding the blank to cause portions of the blank to contact and adhere to the glue panels, thereby forming the food server from the blank.

A preferred, envisioned method of the present invention includes the steps of providing a continuous web of lightweight paper, moving the continuous web at a constant speed until the web is cross cut, printing on both surfaces of the moving web, rotary scoring curved fold lines on and rotary die-cutting and scoring the moving web, using rotary timing belts to pre-bend along score lines on the moving web to define the glue panels before plow folding the moving web, after pre-bending score lines on the moving web to define the glue panels, plow folding the moving web at an angle relative to the direction the web is moving to form angled glue panels thereon, applying glue to the glue panels of the moving web, simultaneously rotary cutting across the moving web to form a blank separate from the web of moving paper where the blank includes the glue panels and vacuum folding the blank to cause portions of the blank to contact and adhere to the angled glue panels, thereby forming the food server from the blank.

The present invention also envisions a food server that includes a first panel having two side flaps where each of the side flaps is defined by a score line on the first panel, and a second panel having two side flaps where each of the side flaps is defined by a score line. Each of the side flaps on the second panel has an outside portion and an inside portion defined by a score line. Adhesive is provided between each of the outside portions of the side flaps on the second panel and each of the side flaps on the first panel to provide that the first panel is adhered to the second panel, thereby forming the food server.

A preferred apparatus according to the present invention envisions a food server comprised of lightweight paper that includes a first panel having two side flaps where each of the side flaps is defined by a score line on the first panel, and a second panel having two side flaps where each of the side flaps is defined by a score line. Both the first panel and the second panel are formed from a single web of paper and have a bottom panel therebetween. Between the bottom panel and the first panel and between the bottom panel and the second panel are curved score lines. Each of the side flaps on the second panel has an outside portion and an inside portion defined by a score line. Adhesive is provided between each of the outside portions of the side flaps on the second panel and each of the side flaps on the first panel to provide that the first panel is adhered to the second panel, thereby forming the food server. When the food server is opened, it provides an opening for receiving food, and each of the outside portions of the side flaps on the second panel has a first surface and an opposing, second surface, where the first surface of each outside panel contacts the food and the second surface of each outside panel is adhered to a side flap of the first panel. The second surface of each outside panel assists in urging the food server into a locked, open position for receiving food when the sides of the food server are urged toward each other.

BRIEF DESCRIPTION OF THE DRAWINGS

The organization and manner of the structure and function of the invention, together with further objects and advantages thereof, may be understood by reference to the following description taken in connection with the accompanying drawings, wherein like reference numerals identify like elements, and in which.

DESCRIPTION

Figure 1:
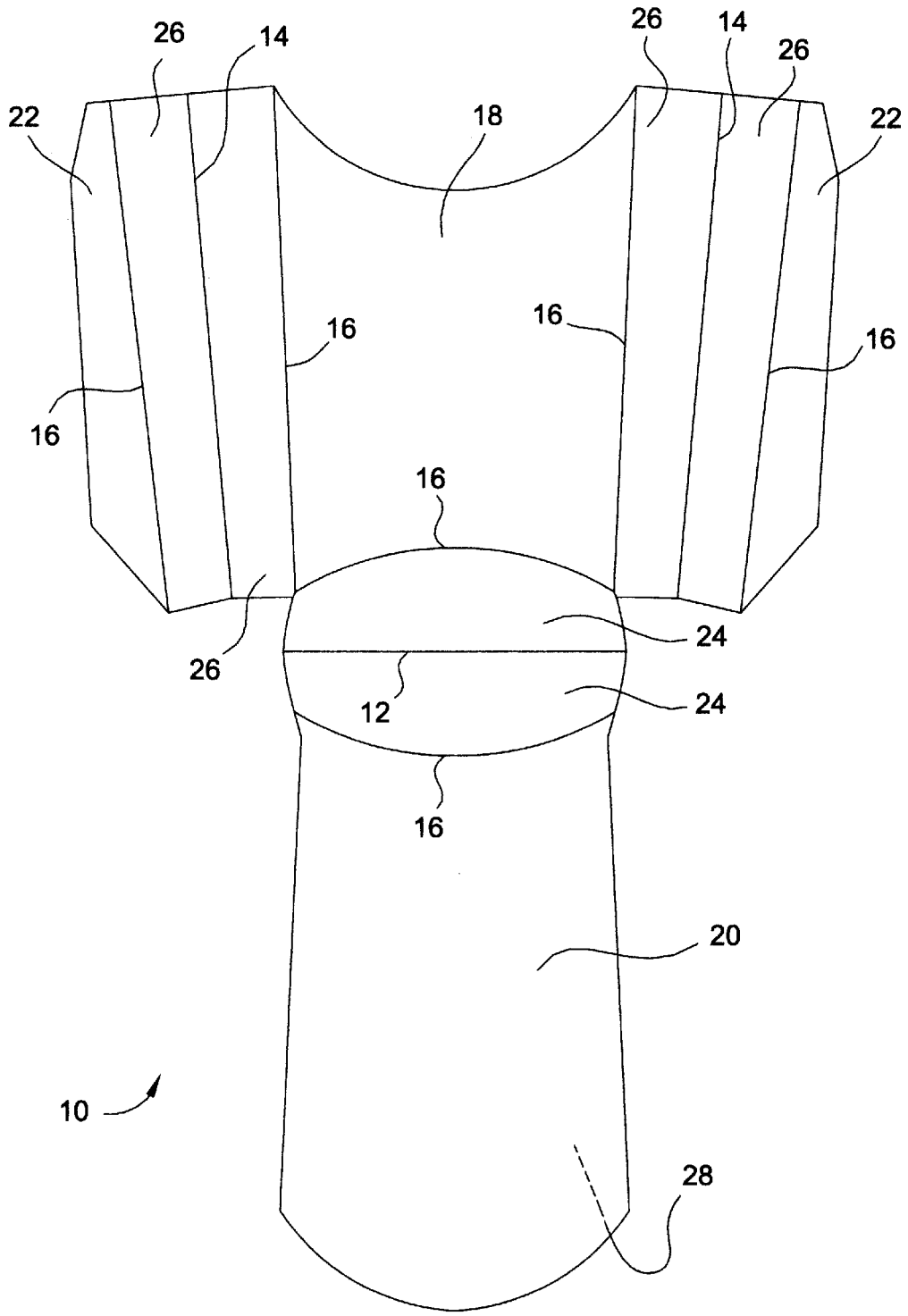
PRIOR ART FIG. 1
FIG. 1 is a top plan view of a prior art blank formed using the typical process of producing a food server.
Figure 2:
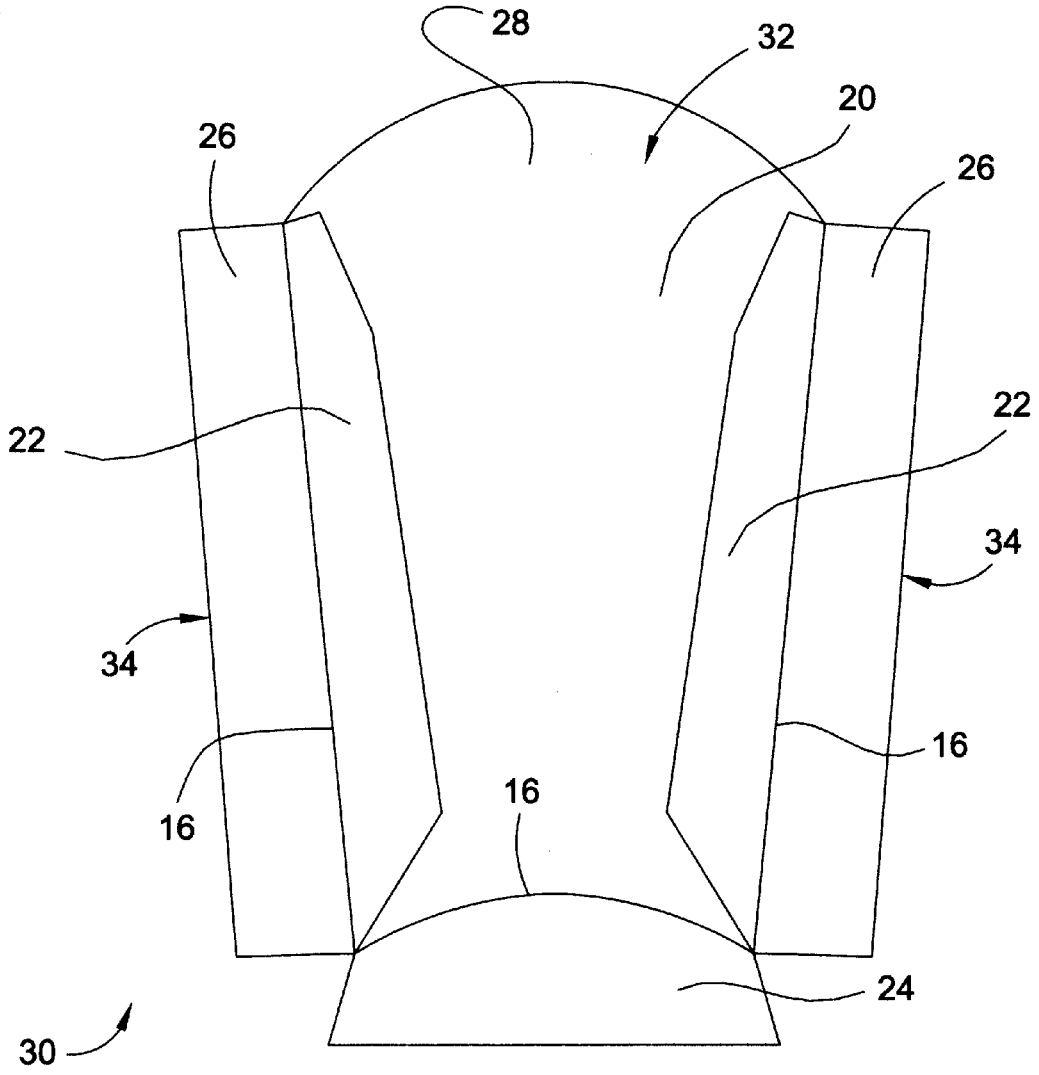
PRIOR ART FIG. 2
FIG. 2 is a side, elevational view of the rear of the prior art food server formed from the blank shown in FIG. 1.

While the present invention may be susceptible to embodiment in different forms, there is shown in the drawings, and herein will be described in detail, certain embodiments with the understanding that the present description is to be considered an exemplification of the principles of the invention and is not intended to limit the invention to that as illustrated and described herein.

The present invention envisions a novel food server and a novel method of producing a food server, both of which provide several advantages over the prior art. A method in accordance with the present invention will now be described referring to the machine 40 depicted in FIG. 6*a* and a web 48 shown in FIG. 6*b*. As shown, initially a roll 42 of paper 44 is provided, and preferably the paper 44 is of lightweight stock such as sixty pound paper. It is desirable to use lightweight stock because lighter paper is less expensive. Additionally, should the food server produced by the machine 40 not be reclaimed, lighter paper lessens the amount of garbage deposited into landfills. Minimizing the amount of garbage deposited into landfills is necessary in light of present day environmental concerns.

Roller 46 initially unwinds a web 48 of paper 44 from the roll 42. The paper 44 may be relatively narrow stock and may have a width 49 of, for example, six and three-eighths inches. However, the roll 42 may be even narrower than six and three-eighths inches wide, or may be substantially wider than six and three-eighths inches wide. For example, it is possible to provide that two or more blanks of the food server are aligned side-by-side on the web 48. In this case, the width of the paper 44 would most likely be greater than six and three-eighths inches.

As shown, the web 48 of paper 44 is essentially two-sided with a first surface 52 of the web 48 opposing a second surface 54 of the web 48. Shown in FIG. 6*b* is a general schematic of the first surface 52 of the web 48 as the web 48 proceeds through the machine 40. As the roller 46 unwinds the web 48, the roller 46 forwards the web 48 to a first printing station 50. The first printing station 50 comprises a plurality of printing rolls 56 which pull the web 48 from the roller 46 and print different colors onto the first surface 52 of the web 48. While the printing rolls 56 print onto the first surface 52 of the web 48, the web 48 keeps moving.

From the first printing station 50, the web 48 is forwarded to a second printing station 58. The second printing station 58 also comprises a plurality of printing rolls 60. The printing rolls 60 of the second printing station 58 pull the web 48 from the first printing station 50 and print different colors onto the second surface 54 of the web 48. Similar to the first printing station 50, while the printing rolls 60 of the second printing station 58 print onto the web 48, the web 48 keeps moving. Therefore, the first and second printing stations 50 and 58 provide that the web 48 gets printed on both sides thereof while the web 48 keeps moving from the roll 42. Preferably, the web 48 proceeds from the roll 42 and though both printing stations 50 and 58 at a constant speed with the web 48 never having to stop.

Figure 3A:
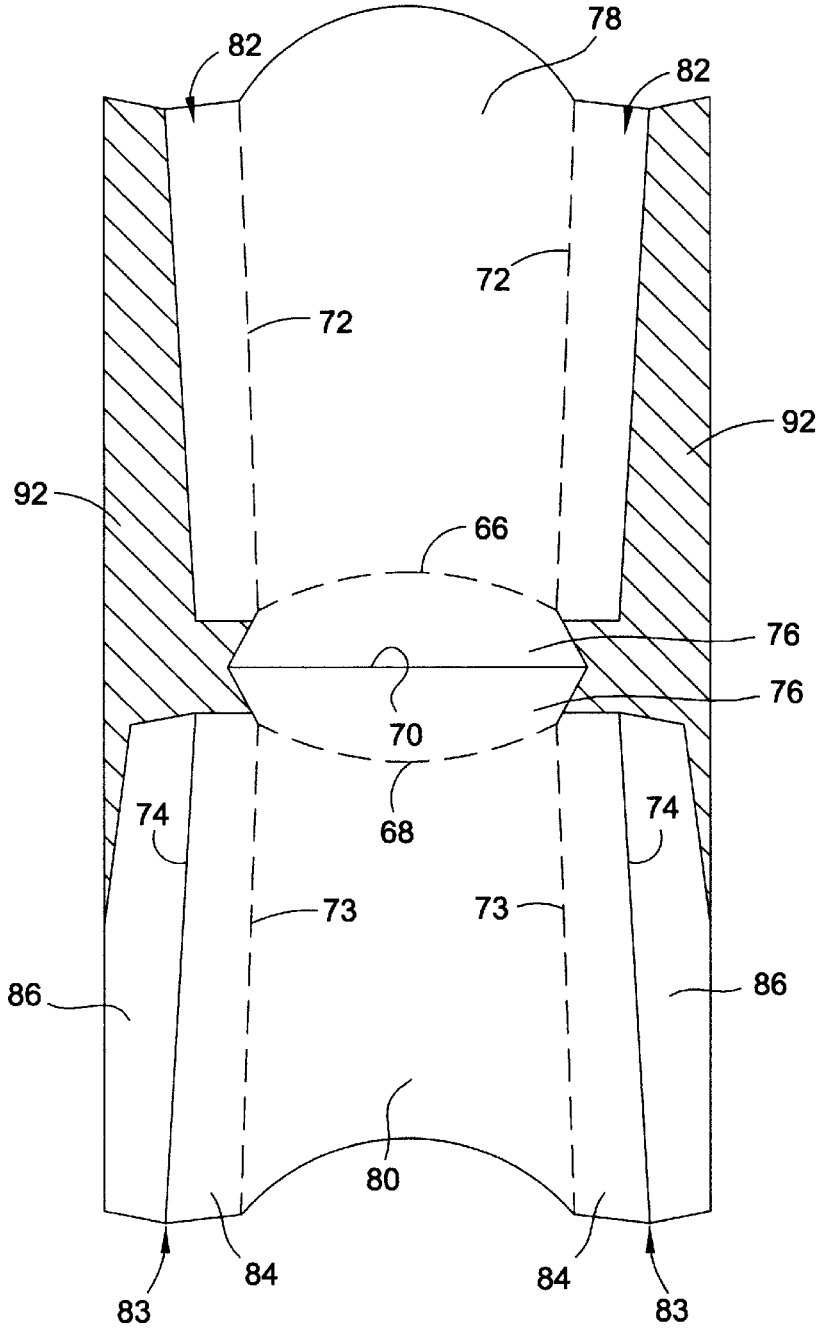
FIG. 3*a* is a top plan view of a blank configured on a web produced within a method in accordance with the present invention.
Figure 4A:
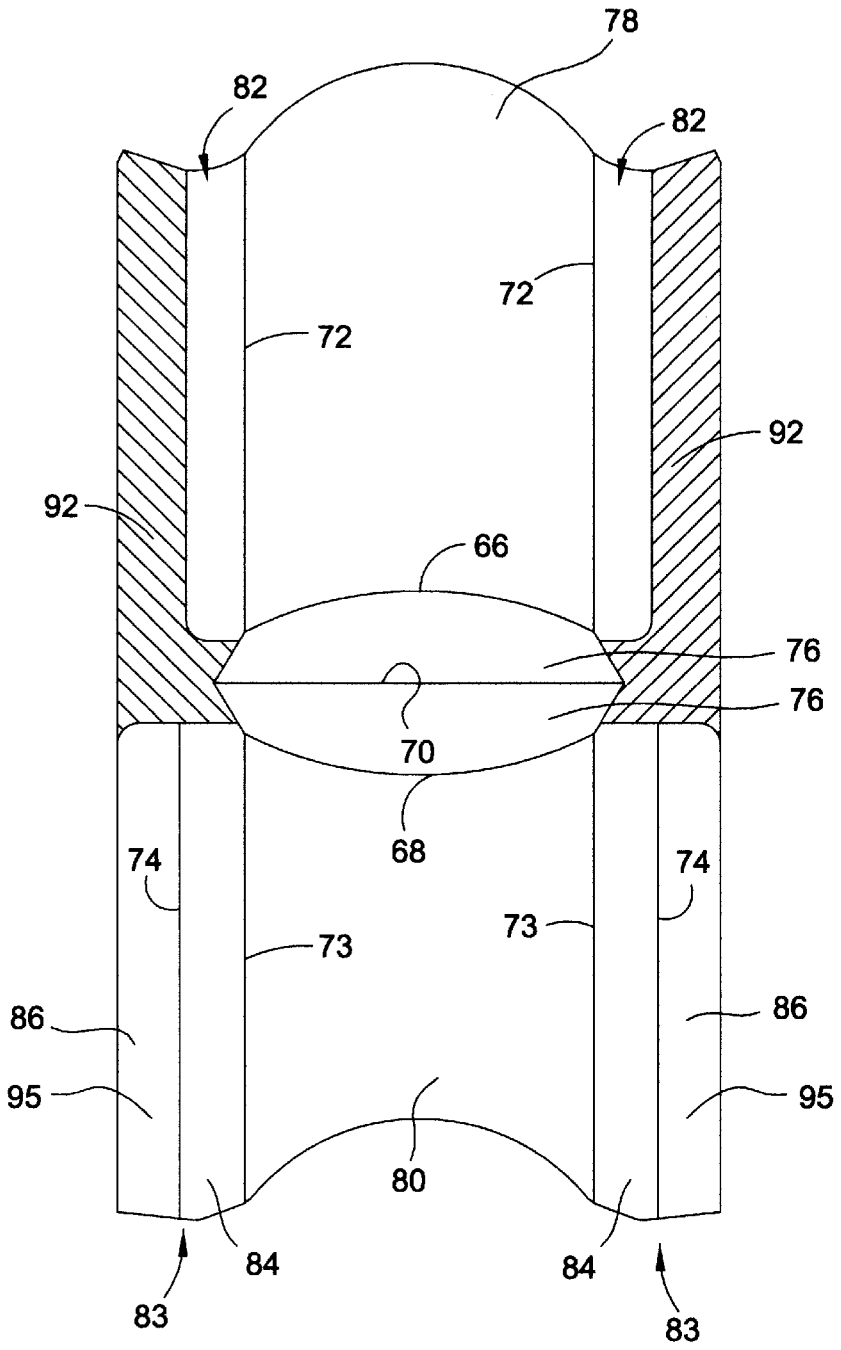
FIG. 4*a* is a top plan view of a second blank configured on a web produced within a method in accordance with the present invention.

From the second printing station 58, the web 48 is forwarded to one or more scoring stations 62 (one shown). As shown, the scoring station 62 comprises a number of rotary scoring blades 64 (two shown). At the one or more scoring stations 62, several lines 66, 68, 70, 72, 73 and 74 are scored onto the web 48, as shown in FIGS. 3*a*, 4*a* and 6. Score lines 66 and 68 define two bottom panels 76 divided by score line 70. As shown, preferably score lines 66 and 68 are curved while score line 70 is substantially straight. Score lines 72 along with score line 66 define a first panel 78 while score lines 73 along with score line 68 define a second panel 80. Score lines 72 also define side flaps 82 adjacent each side of the first panel 78, and score lines 73 also define side flaps 83 adjacent each side of the second panel 80. Each of score lines 74 essentially splits, the side flaps 83 into an inside portion 84 and an outside portion 86.

Score lines 72 may be scored onto the web 48 at an angle relative the direction the web 48 is traveling as the web travels through the one or more scoring stations 62 such that the score lines 72 are angled relative to each other as shown in FIGS. 3*a* and 6*b*. As a result, the side flaps 82 will be tapered, and provided at an angle relative to each other as shown. Additionally, score lines 73 may be scored onto the web 48 at an angle relative the direction the web 48 is traveling such that the score lines 73 are angled relative to each other. As a result, the side flaps 83 will be tapered, and provided at an angle relative to each other. For example, the angled scoring may provide that the side flaps 82 and 83 are angled at six degrees off the direction at which the web travels such that the side flaps 82 and 83 are angled at twelve degrees relative to each other.

Alternatively, score lines 72 may be scored onto the web 48 at substantially the same angle at which the web 48 is traveling as the web travels through the one or more scoring stations 62 such that the score lines 72 are substantially parallel to each other as shown in FIG. 4*a*. Additionally, score lines 73 may be scored onto the web 48 at substantially the same angle at which the web 48 is traveling such that the score lines 73 are substantially parallel to each other. As a result, the side flaps 82 and 83 will all be substantially parallel to each other.

Regardless of the angle at which score lines 72 and 73 are scored onto the web 48, the web 48 continues moving during the scoring by the one or more scoring stations 62. Preferably, the web 48 moves from the roll 42, through the first and second printing stations 50 and 58, and to and through the one or more scoring stations 62 at a constant rate of speed.

Figure 6A:
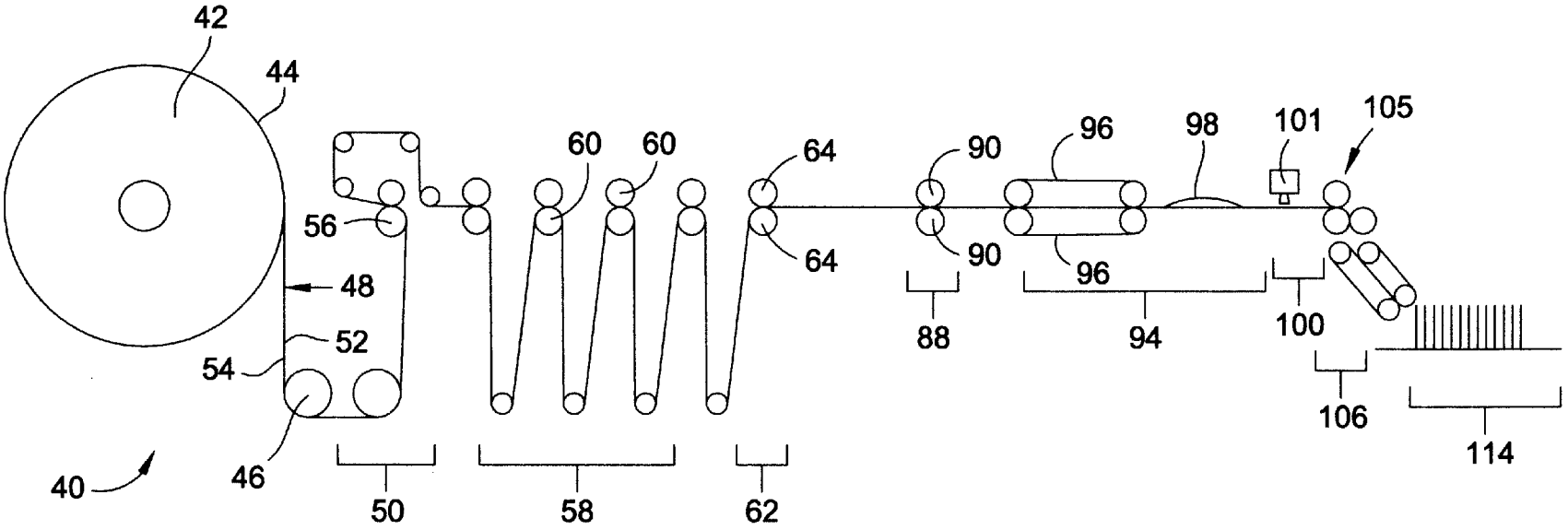
FIG. 6*a* is a schematic view of a machine which can be used to practice a method in accordance with the present invention to produce the first and second embodiment food servers shown in FIGS. 3*b* and 4*b*.
Figure 6B:
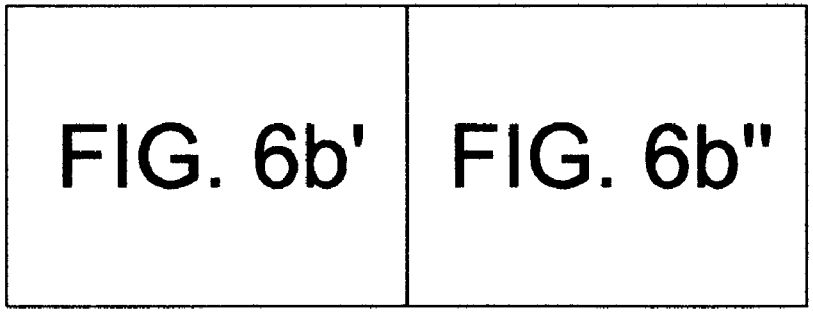
FIG. 6*b* is a schematic view of the sequential operations performed on the web by the machine shown in FIG. 6*a*.

As shown in FIG. 6*a*, from the one or more scoring stations 62, the web 48 is forwarded to a die-cutting station 88. The die-cutting station 88 comprises one or more rotary die cutting blades 90. The rotary die cutting blades 90 trim away scrap portions 92 from the moving web 48. As shown in FIGS. 3*a*, 4*a* and 6*b*, cutting away the scrap portions 92 further defines the side flaps 82 and 83 and the bottom panels 76 on the web 48. By providing that the rotary die-cutting blades 90 perform the die-cutting, it is possible to keep the web 48 moving during the die-cutting step. Keeping the web 48 moving is important because, as a result, more food servers can be produced within a given amount of time. As shown in FIGS. 3*a*, 4*a* and 6*b*, the scrap portions 92 which are cut away from the web 48 are not substantial. Of course, it is desirable to minimize the amount of scrap produced, and the present method provides as such. Additionally, by providing that the rotary die-cutting blades 90 perform the die-cutting, it is possible to use lightweight paper without risking tearing of the paper during the die-cutting.

As mentioned, during the die-cutting step, the web 48 is kept moving. Preferably, the web 48 is kept moving at a constant rate speed from the roll 42, through the first and second printing stations 50 and 58, through the one or more scoring stations 62, and to and through the die-cutting station 88.

As shown in FIG. 6*b*, from the die-cutting station 88, the web travels to the glue flap folding station 94. As shown, the glue flap folding station 94 may comprise rotary timing belts 96 followed by a plow folder 98. The rotary timing belts 96 may be polyurethane timing belts with weld-on profiles. Alternatively, the glue flap folding station 94 may comprise only a plow folder 98 and may not include rotary timing belts 96. However, should the glue flap folding station 94 include rotary timing belts 96, the rotary timing belts 96 are located upstream from the plow folder 98, as shown in FIG. 6*a*. When the web 48 travels to the rotary timing belts 96, the rotary timing belts 96 fold the web 48 along the fold lines 74 such that the outside portion 86 of each side flap 83 is at a ninety degree angle relative to the inside portion 84 of each side flap 83. In this manner, the rotary timing belts 96 pre-fold the outside portions 86 of each side flap 83 before the web 48 travels to the plow folder 98 where the outside portions 86 are completely folded onto the inside portions 84 such that a first surface 95 of each outside portion 86 is contacting an inside portion 84 of each side flap 83. Typically, rotary timing belts 96 will be utilized when angled side flaps 83 are to be produced on light paper as shown in FIG. 3*a*. In contrast, when substantially parallel side flaps 83 are to be produced on heavier paper, typically pre-scoring or pre-folding will not be necessary, and the rotary timing belts 96 need not be utilized. In this case, the glue flap folding station 94 need not include rotary timing belts 96 and may comprise only the plow folder 98. Regardless of which components are, in fact, included within the glue flap folding station 94, the web 48 continues to move as the web 48 approaches and passes through the glue flap folding station 94. Preferably, the web 48 travels at a constant rate of speed during such movement.

Figure 3B:
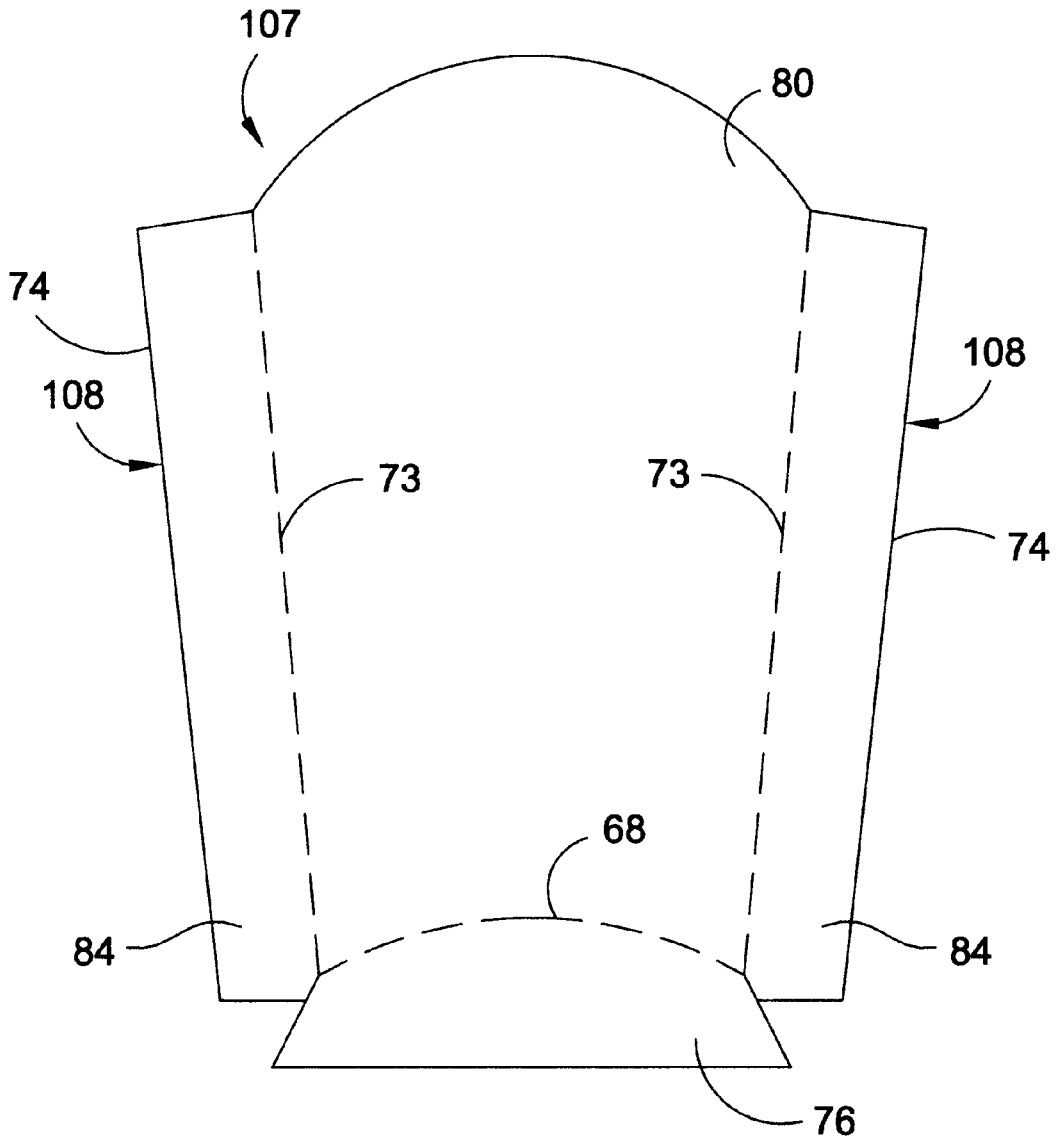
FIG. 3*b* is a side, elevational view of the rear of a first embodiment food server formed from the blank shown in FIG. 3*a;*
Figure 4B:
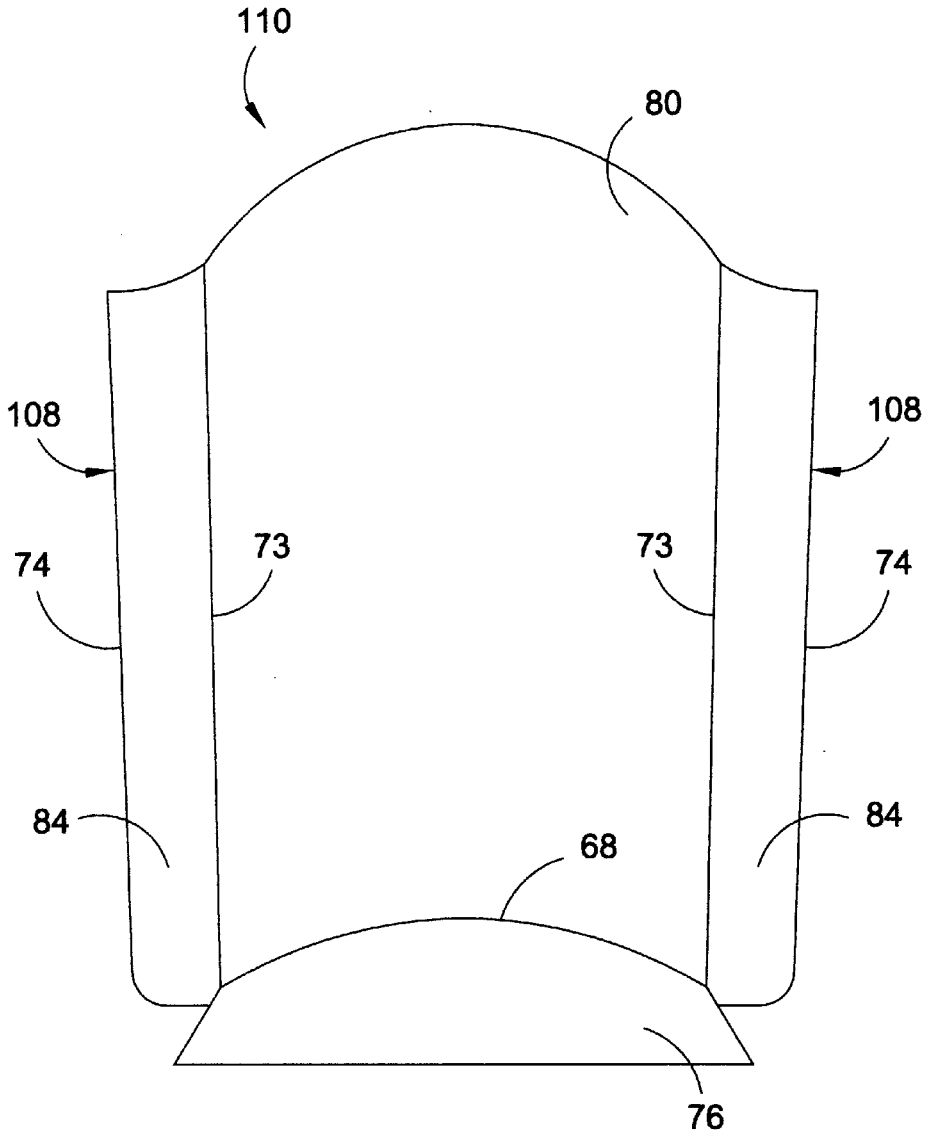
FIG. 4*b* is a side, elevational view of the rear of a second embodiment food server formed from the blank shown in FIG. 4*a*.
Figure 5A:
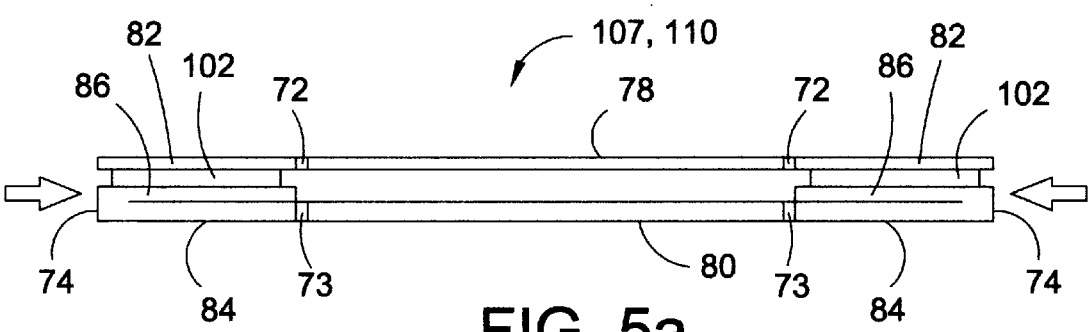
FIG. 5*a* is a nonscaled, top plan view of either the first or second embodiment food servers of FIGS. 3*b* and 4*b*, showing the sides of the food server being pressed together to urge the food server into an open position.

As shown in FIG. 6*a*, from the glue flap folding station 94, the web 48 travels forward to a gluing station 100 comprising a gluer 101 where glue 102 is applied to a second, exposed surface 104 of each outside portion 86 of each of the side flaps 83. Thereafter, the web 48 travels to a rotary cross cutting and folding station 106. At the cross cutting and folding station 106, the web 48 is simultaneously cut by a rotary cutter 105 in a direction traverse to the direction the web 48 travels and is vacuum cross folded along cross line 70 so that the glued, exposed surface 104 of each outside portion 86 of each of the side flaps 83 contacts and adheres to the side flaps 82 adjacent the first panel 78 as shown in FIG. 5*a*. Should the one or more scoring stations 62 score the web 48 to provide that the score lines 72 and 73 are angled as shown in FIG. 3*a*, then the resulting food server 107, after being cross cut and cross folded, will have angled sides 108 as shown in FIG. 3*b*. However, should the one or more scoring stations 62 score the web 48 to provide that the score lines 72 and 73 are substantially parallel as shown in FIG. 4*a*, then the resulting food server 110, after being cross cut and cross folded, will have substantially parallel sides 112 as shown in FIG. 4*b*. Regardless of which food server 107 or 110 is produced, many of the same are typically produced at a time, and then are stacked for delivery after leaving the cross cutting and folding station 106. To this end, each food server 107 or 110 produced is forwarded from the cross cutting and folding station 106 to a delivery-stacker 114 as shown in FIG. 6*a*. Subsequently, the food servers are delivered flat to food vendors, such as fast food restaurants.

One having ordinary skill in the art should recognize that many different modifications can be made to the described method. For example, the scoring, die-cutting, folding and gluing steps need not be performed in the order described, and may, in fact, be performed in any order. Additionally, it is possible to apply glue 102 to the side panels 82 instead of, or in addition to, applying the glue 102 to the outside portion 86 of each side panel 83. Of course, still other modifications are possible while still remaining within the scope of the present invention.

Figure 5B:
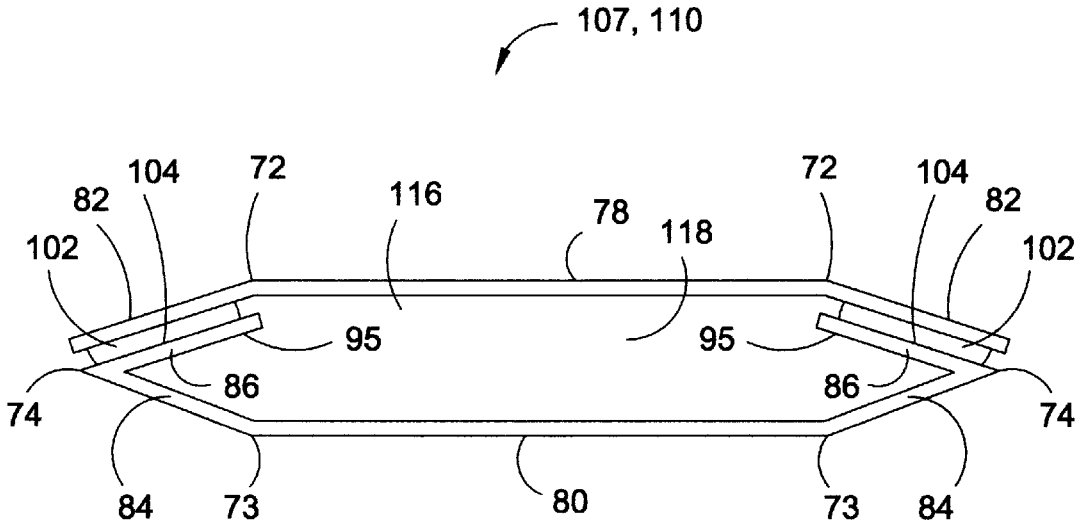
FIG. 5*b* is a nonscaled, top plan view of either the first or second embodiment food servers of FIGS. 3*b* and 4*b*, showing the food server in an open position.

Either of the food servers 107 or 110 shown in FIGS. 3*b* or 4*b*, respectively, provides that when the sides 108 or 112 are lightly urged toward each other, as shown in FIG. 5*a*, the bottom panels 76 (shown in FIGS. 3*a*, 3*b* and 4*a*, 4*b*) shift causing the food server 107 or 110 to lock into an open position as shown in FIG. 5*b*. When the food server 107 or 110 is locked into the open position as shown, the food server 107 or 110 provides an opening 116 for receiving food 118 such as french fries therein. When food 118 is received by the food server 107 or 110, the food 118 can contact the first surface 95 of the outside portion 86 of each of the side flaps 83 while the second, opposing surface 104 of the outside portion 86 of each of the side flaps 83 is glued to a corresponding side flap 82. By providing that each side flap 83 is glued to a side flap 82 inside the food server 107 or 110 rather than being glued to the second panel on the outside of the food server 107 and 112, either food server 107 or 110 provides that the outside portions 86 of the glue flaps 83 assist in the opening of the food server 107 or 112. As a result, either food server 107 or 110 is easier to open merely by lightly urging the sides 108 or 112 toward each other. Additionally, as shown in FIGS. 3*b* and 4*b*, by providing that each side flap 83 is glued to a side flap 82 inside the food server 107 or 110, both panels 78 and 80 are practical for providing attention-grabbing graphics thereon, such as a logo.

The above-described novel method of producing a food server provides many advantages over the prior art. As mentioned above, the web 48 is kept moving as the web proceeds from the printing stations 50 and 58, to the one or more scoring stations 62, to the die-cutting station 88, to the glue flap folding station 94, to the gluing station 100, to the rotary cross cutting and folding station 106, and finally to the delivery-stacker 114. Preferably, the web 48 moves at a constant rate of speed as it proceeds, and slows down only when reaching the delivery-stacker 114. In this manner, the described method provides a continuous, single stage method of producing food servers, and provides that the food servers can be produced extremely quickly. In fact, the method provides that 60,000 food servers can be produced in one hour. Additionally, the food servers can be produced in one stream or multiple streams with the same scrap rate. Side-by-side nesting is not necessary to provide that the amount of scrap produced is reasonable. Still further, the method provides that lighter weight paper can be used thereby providing that food servers can be produced less costly.

Wile a preferred embodiment of the present invention is shown and described, it is envisioned that those skilled in the art may devise various modifications and equivalents without departing from the spirit and scope of the invention as defined by the appended claims. The invention is not intended to be limited by the foregoing disclosure.

The invention claimed is:

1. A method of producing a food server, said method comprising:

providing a continuous web of paper having a first surface and a second, opposing surface;

moving said continuous web of paper;

printing on at least one of said surfaces of said web of paper;

scoring fold lines on said moving web of paper thereby defining glue panels on said web;

die-cutting said moving web of paper;

partially folding said glue panels such that said glue panels are orientated generally at a ninety degree angle relative to a remainder of the web;

after partially folding said glue panels, further folding said glue panels by plow folding said glue panels;

applying glue to said glue panels on said moving web of paper;

after applying glue to the glue panels cutting across said moving web of paper to form a blank separate from said web of moving paper, said blank including said glue panels; and folding said blank to cause portions of said blank to contact and adhere to said glue panels, thereby forming said food server from said blank.

2. A method according to claim 1, wherein the step of die-cutting said moving web of paper comprises rotary die-cutting said moving web of paper, and wherein the step of scoring fold lines on said moving web of paper comprises rotary scoring fold lines which are curved in a direction which is transverse to movement of said web.

3. A method according to claim 1, wherein said web of paper is plow folded to form glue panels which are angled relative to a direction of movement of said web.

4. A method according to claim 1, further comprising using rotary timing belts to partially fold said glue panels such that said glue panels are orientated generally at a ninety degree angle relative to the remainder of the web.

5. A method according to claim 1, wherein said web of paper comprises a roll of sixty pound paper about six and three eighths inches wide.

6. A method according to claim 1, wherein the step of printing on at least one of said surfaces of said web of paper comprises printing on said first surface and said second, opposing surface of said web of paper while said web of paper is moving.

7. A method according to claim 1, wherein the step of folding said blank comprises vacuum folding said blank.

8. A method according to claim 1, further comprising nesting a series of blanks from said web in a direction parallel to the direction said web of paper is moving.

9. A method according to claim 1, wherein the step of moving said web of paper comprises moving said web at a constant speed until the step of cutting across said web of paper is performed.

10. A method of producing a food server, said method comprising:

providing a web of paper;

providing rotary timing belts;

moving said web of paper at a constant rate of speed;

rotary perforating or scoring a plurality of lines on said moving web of paper, thereby defining glue panels thereon;

rotary die-cutting said moving web of paper to cut away portions of said paper adjacent said glue panels;

using said rotary timing belts to partially fold said glue panels such that said glue panels are orientated generally at a ninety degree angle relative to a remainder of the web;

after using said rotary timing belts to partially fold said glue panels, further folding said glue panels by plow folding said glue panels;

applying glue to said moving web of paper;

after plow folding along said fold lines and after applying glue to said moving web of paper, cutting across said moving web of paper to form a blank having said glue panels; and vacuum folding said blank to cause portions of said blank to contact and adhere to said glue panels, thereby forming said food server from said blank.

11. A method according to claim 1, further comprising adding said food server to a stack, said food server not being gummed on an external surface of said food server.

* * * * *